US011305350B2

(12) United States Patent
Gong

(10) Patent No.: US 11,305,350 B2
(45) Date of Patent: Apr. 19, 2022

(54) METHOD FOR PREPARING SILVER POWDER BY USING MICRO-NANO BUBBLES AS CRYSTAL SEEDS

(71) Applicant: SUZHOU SMART ADVANCED COATING TECHNOLOGIES CO., LTD., Suzhou (CN)

(72) Inventor: Qiang Gong, Suzhou (CN)

(73) Assignee: SUZHOU SMART ADVANCED COATING TECHNOLOGIES CO., LTD., Suzhou (CN)

( * ) Notice: Subject to any disclaimer, the term of this patent is extended or adjusted under 35 U.S.C. 154(b) by 642 days.

(21) Appl. No.: 16/078,164

(22) PCT Filed: Jun. 15, 2017

(86) PCT No.: PCT/CN2017/088534
§ 371 (c)(1),
(2) Date: Aug. 21, 2018

(87) PCT Pub. No.: WO2017/190712
PCT Pub. Date: Nov. 9, 2017

(65) Prior Publication Data

US 2019/0039142 A1 Feb. 7, 2019

(30) Foreign Application Priority Data

May 4, 2016 (CN) ..... 201610288834.6

(51) Int. Cl.
*B22F 9/24* (2006.01)
*C22C 5/06* (2006.01)
(Continued)

(52) U.S. Cl.
CPC ..... *B22F 9/24* (2013.01); *C22C 5/06* (2013.01); *B22F 1/05* (2022.01); *B22F 1/054* (2022.01); *B22F 1/07* (2022.01); *B22F 2998/10* (2013.01)

(58) Field of Classification Search
CPC ..... B22F 9/24; C22C 5/06
See application file for complete search history.

(56) References Cited

U.S. PATENT DOCUMENTS

2009/0202867 A1* 8/2009 Ohsugi ..... H01F 1/11 428/846
2010/0143183 A1* 6/2010 Martinez ..... C22B 5/00 420/501
(Continued)

FOREIGN PATENT DOCUMENTS

CN 1785558 A 6/2006
CN 102274975 A 12/2011
(Continued)

OTHER PUBLICATIONS

Wang, Qiaozhi, et al. "Generation and Stability of Size-Adjustable Bulk Nanobubbles Based on Periodic Pressure Change." Scientific Reports, vol. 9, No. 1, 2019 (Year: 2019).*

*Primary Examiner* — Paul A Wartalowicz
*Assistant Examiner* — Ryan L Heckman
(74) *Attorney, Agent, or Firm* — SZDC Law P.C.

(57) ABSTRACT

A preparation method using micro-nano bubbles as crystal seeds to induce spherical or spherical-type silver power production, said method specifically comprising the steps of: pre-adding a prepared dispersing agent solution to a reaction vessel, within the reaction vessel, simultaneously adding a prepared oxidizing solution (an aqueous solution containing silver ions or a silver ammonia solution) and a reducing solution (an aqueous solution containing one or a plurality of hydroxylamine compounds, vitamin C, formaldehyde or
(Continued)

hydrazine hydrate), performing a reduction reaction under vigorous stirring, and using the pre-generated micro-nano bubbles within the dispersing agent solution as crystal seeds, the micro-nano bubbles crystal seeds effectively controlling the particle size of reduced silver particles throughout the reduction reaction. The method effectively controls the particle size of the silver powder during production, and also controls the crystal nucleus growth rate and dispersibility.

3 Claims, 3 Drawing Sheets

(51) Int. Cl.

| | |
|---|---|
| ***B22F 1/05*** | (2022.01) |
| ***B22F 1/07*** | (2022.01) |
| ***B22F 1/054*** | (2022.01) |

(56) References Cited

U.S. PATENT DOCUMENTS

2010/0224026 A1* 9/2010 Brennan Fournet ..... B22F 9/24 75/370
2011/0236709 A1* 9/2011 Jablonski ..... B22F 1/0022 428/546
2013/0270488 A1* 10/2013 Ueyama ..... B22F 1/0022 252/512
2014/0272580 A1* 9/2014 Frianeza-Kullburg ..... H01M 4/5825 429/218.1
2014/0308158 A1* 10/2014 Maekawa ..... C22C 5/06 420/456
2015/0107412 A1* 4/2015 Lee ..... B22F 9/06 75/355
2015/0259815 A1* 9/2015 Shinohara ..... H01R 13/03 428/673
2016/0152851 A1* 6/2016 Zhang ..... B22F 1/0074 252/514
2016/0185973 A1* 6/2016 Becker-Willinger ..... B22F 9/24 252/519.2
2017/0140846 A1* 5/2017 Park ..... B22F 1/0025

FOREIGN PATENT DOCUMENTS

| | | | |
|---|---|---|---|
| CN | 103273083 | A | 9/2013 |
| CN | 104128616 | A | 11/2014 |
| CN | 104646683 | A | 5/2015 |
| CN | 105436517 | A | 3/2016 |
| CN | 105834449 | A | 8/2016 |
| GB | 2390846 | A | 1/2004 |
| JP | 5725699 | B2 | 5/2015 |
| JP | 2015172235 | A | 10/2015 |

* cited by examiner

| size μm | content % |
|---|---|
| 0.30 | 3.51 |
| 0.80 | 83.76 |
| 2.00 | 100.00 |
| 10.00 | 100.00 |
| 20.00 | 100.00 |
| 35.00 | 100.00 |
| 40.00 | 100.00 |
| 42.00 | 100.00 |
| 45.00 | 100.00 |
| 50.00 | 100.00 |

| size μm | content % |
|---|---|
| 0.30 | 0.00 |
| 0.80 | 0.08 |
| 2.00 | 56.09 |
| 10.00 | 100.00 |
| 20.00 | 100.00 |
| 35.00 | 100.00 |
| 40.00 | 100.00 |
| 42.00 | 100.00 |
| 45.00 | 100.00 |
| 50.00 | 100.00 |

| size μm | content % |
|---|---|
| 0.30 | 0.00 |
| 0.80 | 0.01 |
| 2.00 | 28.90 |
| 10.00 | 100.00 |
| 20.00 | 100.00 |
| 35.00 | 100.00 |
| 40.00 | 100.00 |
| 42.00 | 100.00 |
| 45.00 | 100.00 |
| 50.00 | 100.00 |

METHOD FOR PREPARING SILVER POWDER BY USING MICRO-NANO BUBBLES AS CRYSTAL SEEDS

CROSS-REFERENCE TO RELATED PATENT APPLICATIONS

This application is a national phase application of PCT/CN2017/088534, filed on Jun. 15, 2017, which claims the priority benefit of Chinese Patent Application No. 201610288834.6, filed on May 4, 2016, which is incorporated by reference in its entirety.

TECHNICAL FIELD

The present invention relates to the technical field of materials, in particular to a method for preparing micron-sized silver powder.

BACKGROUND

Silver powder has a wide range of applications in solar energy, manufacturing of electronic components and electroplating and batteries of the electronic industry, chemical catalysis, jewelry and other industries. With the development of electronic components in the direction of miniaturization and high performance, higher requirements are placed on the performance indexes such as sintering activity, dispersibility, sphericity and crystallinity of silver powder. At present, the method for preparing silver powder includes physical methods such as an atomization method, a vapor phase evaporation condensation method and a grinding method, and chemical methods such as a liquid phase reduction method, an electrochemical deposition method and an electrolysis method. Due to the high cost and low yield of the physical methods, the method that is widely used nowadays is the liquid phase reduction method of the chemical methods, by which a chemical reaction is used to reduce silver in a silver ion-containing salt solution or silver oxide to produce silver powder, as disclosed in the patent CN2014 1 0394624.6 in which the liquid phase reduction method was used to produce silver powder from a silver-containing metal salt.

Metal powder is customarily divided into five grades of coarse powder, medium powder, fine powder, micro-fine powder and super-fine powder. The powder particles produced by the reduction method mostly have an irregular shape of a sponge structure. The particle size of the powder depends mainly on factors such as the reduction temperature, time and particle size of the raw material. The present invention is proposed so as to solve the above technical problems.

SUMMARY

A purpose of the present invention is to provide a method for preparing micron-sized silver powder different from the prior art.

In order to achieve the purpose, a technical solution of the present invention is to provide a method for preparing silver powder by using micro-nano bubbles as crystal seeds to induce the production of silver powder. This method is characterized in that it comprises the following steps:

(1) Preparation of an oxidant solution: a solid of metal nitrate or sulfate is dissolved in deionized water, or ammonia water is further added, to form a complex metal ammonia solution, with concentration of [metal ion] in the oxidant solution maintained at 0.1-10 mol/L, or one or more of polyvinylpyrrolidone (PVP), polyethylene glycol 400, Tween 40 and glycerol is/are further added, and the oxidant solution is kept at a constant temperature of 10° C. to 50° C. after being fully stirred;

(2) preparation of a reductant solution: one or more hydroxylamine compound solids or vitamin C or formaldehyde or hydrazine hydrate reductant is added to deionized water to obtain a reductant solution, wherein concentration of [reducing agent] in the reductant solution is maintained at 0.1-10 mol/L, the volume of the reductant solution is 0.5-5 times that of the oxidant solution, and the reductant solution is kept at a constant temperature of 10° C. to 50° C. after being fully stirred;

(3) preparation of a dispersant solution: one or more dispersants is/are added to deionized water to obtain a dispersant solution, with the total mass of the dispersant in deionized water is 0.01-5 times that of silver in the oxidant solution, and the dispersant solution is kept at a constant temperature of 10° C. to 50° C. after being fully stirred;

(4) preparation of a flocculant: oleic acid with a mass of 0.01% to 10% of metal powder produced by each batch of reaction or one or more oleates with a mass of 0.01% to 10% of the metal powder produced by reaction is/are weighed and added to a flocculant preparation tank, and then a small amount of alcohol is further added to the tank to get dissolved to obtain a flocculant;

(5) before the reaction, the prepared dispersant solution is added to a reaction vessel and then stirred, meanwhile a micro-nano bubble generator is turned on to generate controllable micro-nano bubbles having a diameter of 0.1-900 nm in the dispersant solution in the reaction vessel, and then the oxidant solution and the reductant solution are added simultaneously at a constant flow rate of 0.1-100 L/min; and (6) after completion of the reaction, the solution in the reaction vessel is discharged into a flocculation sedimentation tank, a flocculant is added, and the mixture is rapidly stirred for 1-60 min and allowed to stand for precipitation, so that the silver powder in various ranges of particle size is obtained by separation.

In a preferred technical solution of the present invention, the reductant in the preparation of the reductant solution in the step (2) is selected from the group consisting of hydroxylamine, hydroxylamine sulfate, hydroxylamine nitrate, vitamin C, a formaldehyde solution of 37% to 40%, and hydrazine hydrate, or a mixture of two or more thereof.

In the preferred technical solution of the present invention, the molar ratio of the metal ion in the above step (1) to the reductant in the solution is as follows: [metal ion]:[hydroxylamine]=1:0.1-10, or [metal ion]:[hydroxylamine sulfate]=1:0.1-10, or [metal ion]:[hydroxylamine nitrate]=1:0.1-10, or [metal ion]:[vitamin C]=1:0.1-10, or [metal ion]:[formaldehyde]=1:0.1-0, or [metal ion]:[hydrazine hydrate]=1:0.1-10; and the solution is kept at a constant temperature of 10° C. to 50° C. after being fully stirred.

In the preferred technical solution of the present invention, the dispersant in the step (3) is selected from one or more of polyvinylpyrrolidone (PVP), polyethylene glycol 400, Tween 40 and glycerol, and added to the deionized water whose volume is 0.5-2 times the volume of the aforementioned reductant solution; in this step, the agglomeration of the micro-nano silver particles is inhibited by the dispersant at the initial stage of the self-reaction, so that quantitative micro-nano silver particles are present in the reaction system to get the subsequent generation of the metal particles controlled, and the reduction growth system with controlled particle size is obtained, which has a good control effect on the reduction rate and the growth rate of the crystal nucleus.

In the preferred technical solution of the present invention, the micro-nano bubble generated by the micro-nano bubble generator in the step (5) has a diameter of 1-900 nm, more preferably 1-500 nm.

In the preferred technical solution of the present invention, the micro-nano bubbles generated in the dispersant solution in the step (5) in advance are used as the nano crystal seeds in the dispersant solution, and the silver ions and the reductant react on the surface of the bubble film. The micro-nano bubbles can effectively inhibit the agglomeration of these new micro-nano silver particles, such that these new quantitative micro-nano silver particles are utilized to control the continuous generation of silver particles in the whole reaction system, the reduction growth system with controlled particle size is obtained, and a good control effect on the reduction rate and the growth rate of the crystal nucleus is achieved, with the loose structure inside the silver powder particles especially very helpful for the activity of the silver powder.

In the preferred technical solution of the present invention, the silver powder is spherical and nearly spherical micron-sized particles having a particle diameter of 0.1-10 um.

In the preferred technical solution of the present invention, the inside of the silver powder particles is of a loose structure.

A second aspect of the present invention claims a silver powder prepared by the above method.

In the dispersant solution of the present invention, according to the production requirements of the silver powder of different particle sizes, the number of the micro-nano bubbles generated in the initial stage of reaction in the dispersant can be adjusted to produce micron-sized silver powder products of different particle sizes, such that in the production process the number of the micro-nano bubbles generated can be adjusted according to the requirements of the particle size of the specifically produced metal powder.

The present invention has the following advantages and benefits:

(1) The method of the present invention introduces micro-nano bubble crystal seeds into the dispersant solution previously added to the reaction vessel, so that the particle size can be controlled during the reduction process of silver ions, and silver ions can be quickly and stably reduced from the silver-ammonia solution or silver ion salt solution to silver powder, and it is ensured that the formed silver powder has spherical or nearly spherical morphology, and the particle size can be adjusted by the number of the introduced micro-nano bubble crystal seeds.

(2) The method of the present invention can effectively control the reaction rate of the spherical and nearly spherical silver powder in the production process, and have good control effects on the growth rate and dispersibility of the crystal nucleus; and the produced spherical and nearly spherical silver powder has very good crystallinity and sphericity as well as high tap property and dispersibility, especially the loose structure inside the silver powder particles that is very helpful for the activity of silver powder.

(3) The preparation method of the present invention can be applied to industrial production; for example, the large-scale production of the silver powder can reach 5-150 kg/batch, which has significant advantages over the laboratory preparation method of the existing silver powder production technology.

(4) The preparation method of the present invention is simple, the raw materials are cheap, the process is easy to control, the reaction is complete, and the quality of the batches of the produced products is stable, thereby greatly reducing the product failure rate and bringing considerable economic benefits to the enterprise.

BRIEF DESCRIPTION OF DRAWINGS

FIG. 3 is an SEM electron micrograph of the spherical silver powder prepared by the method of the present invention, wherein: FIG. 3A is an SEM electron micrograph of a spherical silver powder magnified 20,000 times; FIG. 3B is an SEM electron micrograph of a spherical silver powder magnified 5000 times; FIG. 3C is an SEM electron micrograph of a spherical silver powder magnified 5000 times; FIG. 3D is an SEM electron micrograph of a spherical silver powder magnified 20000 times; FIG. 3E is an SEM electron micrograph of a spherical silver powder magnified 2000 times; and FIG. 3F is an SEM electron micrograph of a spherical silver powder magnified 2000 times.

DETAILED DESCRIPTION OF PREFERRED EMBODIMENTS

Figure 1:
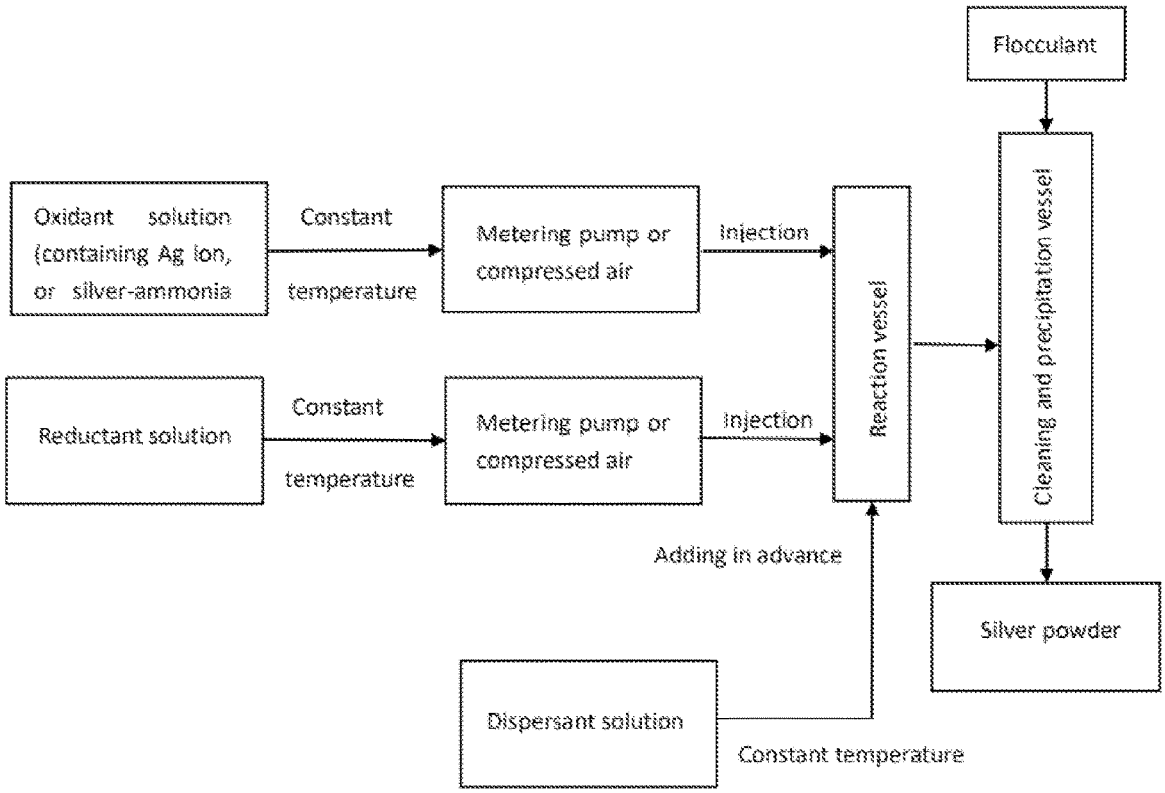
FIG. 1 is a flow chart of the method of the present invention.
Figure 2A:
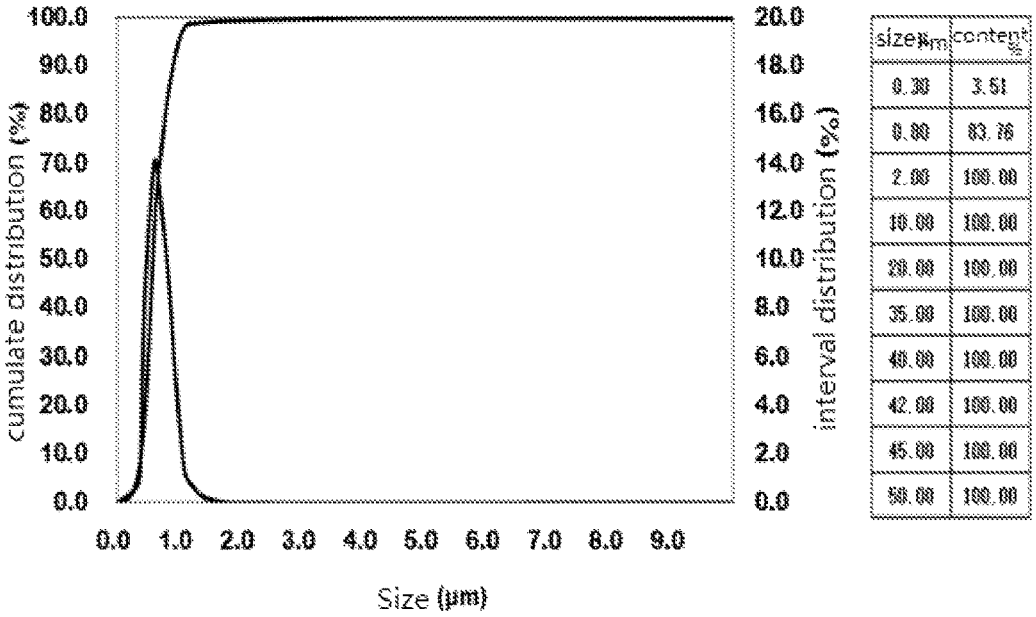
FIGS. 2A, 2B and 2C are schematic views showing detection of the particle size of the silver powder prepared by the method of the present invention.
Figure 2B:
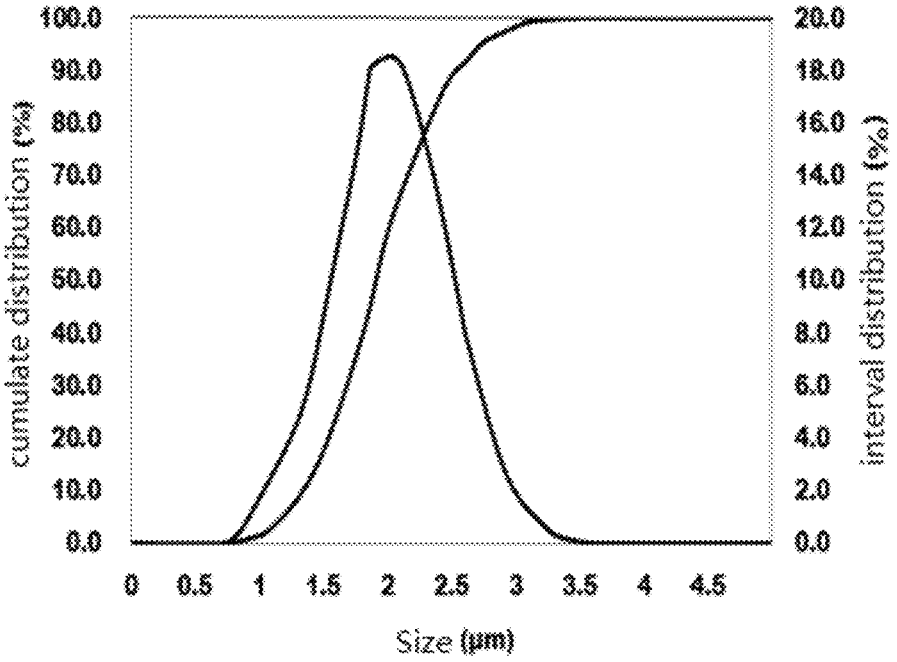
Figure 2C:
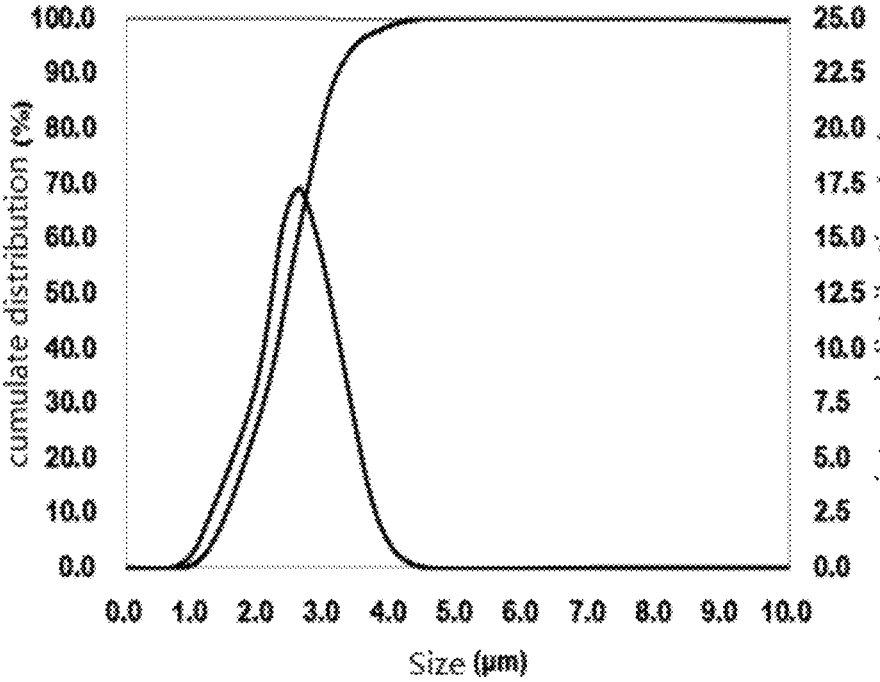

The present invention will be described in conjunction with the preferred solutions of the present invention; however, it should be understood that the descriptions are only to further illustrate the features and advantages of the present invention, rather than limiting the claims of the present invention.

The micro-nano bubble generator applied in the present invention is an ordinary commercially available instrument.

Example 1 (Silver Powder S001)

(1) Preparation of an oxidant solution containing silver nitrate: silver nitrate salt solid or equivalent silver nitrate liquid is dissolved in deionized water, the molar concentration of silver ions in the solution [silver ion] is kept at 0.3 mol/L, and the solution is kept at a constant temperature of 20° C. to 30° C.;

(2) preparation of a reductant solution containing hydrazine hydrate: a hydrazine hydrate solution is added to deionized water, the molar ratio of [silver ion]:[hydrazine hydrate] in the solution is kept at 1:0.1-5 according to the silver content in the silver-containing oxidant solution, and the solution is kept at a constant temperature of 10° C. to 50° C.;

(3) preparation of a dispersant solution: one or more kinds of PVP or polyethylene glycol 400 are dissolved at a content of 50-100 g/L in deionized water to obtain a dispersant solution, and the solution is stirred well and kept at a constant temperature of 10° C. to 50° C.; and (4) the dispersant solution containing the compound of PVP or polyethylene glycol 400 is pre-dispensed into the reaction vessel by using a metering pump, and simultaneously a micro-nano bubble generator is turned on to generate controllable micro-nano bubbles in the dispersant solution in the reaction vessel, and then the oxidant solution containing silver and the reductant solution containing hydrazine hydrate are quantitatively sprayed into the reaction vessel through micropores (flow rate: 10-20 L/min); the reduction reaction is carried out under vigorous stirring (300 rpm) and, after completion of the reaction, silver powder of various ranges of particle size is obtained by precipitation through addition of a flocculant.

Example 2 (Silver Powder S002)

Preparation of an oxidant solution: 500 mL of silver nitrate solution containing 180 g/L of silver is prepared in a jar of 2000 mL, and 200 mL of ammonia water with a concentration of 18% by mass is added to the jar to obtain a silver-ammonia solution, which is heated to 45° C. and kept constant for future use;

preparation of a reductant solution: 50 g of hydroxylamine sulfate and 50 g of vitamin C are dissolved in 500 mL of deionized water in another jar of 2000 mL to obtain a solution containing vitamin C and hydroxylamine sulfate, and the solution is heated to 45° C. and kept constant for future use;

preparation of a dispersant solution: 65 g of PVP and 40 mL of Tween 40 are dissolved in 250 mL of deionized water in a jar of 500 mL to obtain a dispersant solution, and the solution is heated to 35° C. and kept constant for future use;

35 kg of PVP is dissolved in 400 L of deionized water in a preparation tank of 500 L and stirred well, and the solution is heated to 35° C. and kept constant for future use (dispersant solution); and a metering pump is used to pump the dispersant solution in advance into a jar of 3000 L, and a micro-nano bubble generator is turned on simultaneously to generate controllable micro-nano bubbles in the dispersant solution in the reaction vessel, and then the above prepared oxidant solution and reductant solution are spray-mixed quantitatively in the reaction vessel through micropores, with the injection flow rate of the two solutions controlled at 50 L/min; stirring is started at a stirring rate of 120 rpm; the dispersant solution is added dropwise during the reaction and, after completion of the reaction, the reaction liquid is discharged into a flocculation sedimentation tank of 5000 L, a flocculant is added, and stirring is started at a stirring rate of 300 rpm; and the mixture is rapidly stirred for 30 min and then allowed to stand for precipitation, so that the spherical or nearly spherical silver powder having an average particle size of 0.1-10 um is obtained by separation.

Table 1 shows the detection data of three groups of silver powder prepared according to the method of the present invention.

| | | Silver powder index | | |
|---|---|---|---|---|
| | | Silver powder S001 | Silver powder S002 | Silver powder S003 |
| Powder parameter | D100 | <1.0 μm | <10 μm | <6 μm |
| | D90 | 0.8 ± 0.2 μm | 3.5 ± 0.2 μm | 3.0 ± 0.2 μm |
| | D50 | 0.6 ± 0.2 μm | 2.5 ± 0.2 μm | 1.7 ± 0.2 μm |
| | D10 | 0.4 ± 0.2 μm | 1.8 ± 0.2 μm | 1.0 ± 0.2 μm |
| | Specific surface area | 0.8-1.1 $m^2/g$ | 0.2-0.5 $m^2/g$ | 0.3-0.6 $m^2/g$ |
| | Tap density | ≥3.5 $g/cm^3$ | ≥5.5 $g/cm^3$ | ≥5.0 $g/cm^3$ |
| | Burning loss (530° C.) | <0.7% | <0.5% | <0.6% |
| | Morphology | Spherical | Spherical | Spherical |

a metering pump is used to pump the dispersant solution in advance into a jar of 5000 mL, and a micro-nano bubble generator is turned on simultaneously to generate controllable micro-nano bubbles in the dispersant solution in the reaction vessel, and then the above prepared oxidant solution and reductant solution are simultaneously added dropwise quantitatively to a jar of 5000 mL through micropores and mixed, with the flow rate of the two solutions controlled at 150 mL/min; stirring is started at a stirring rate of 400 rpm; after completion of the reaction, the flocculant is added and stirred for 10 min, and the solution is allowed to stand for precipitation, so that spherical or nearly spherical silver powder is obtained by separation.

Example 3: Mass Production (Silver Powder S003)

Figure 3:
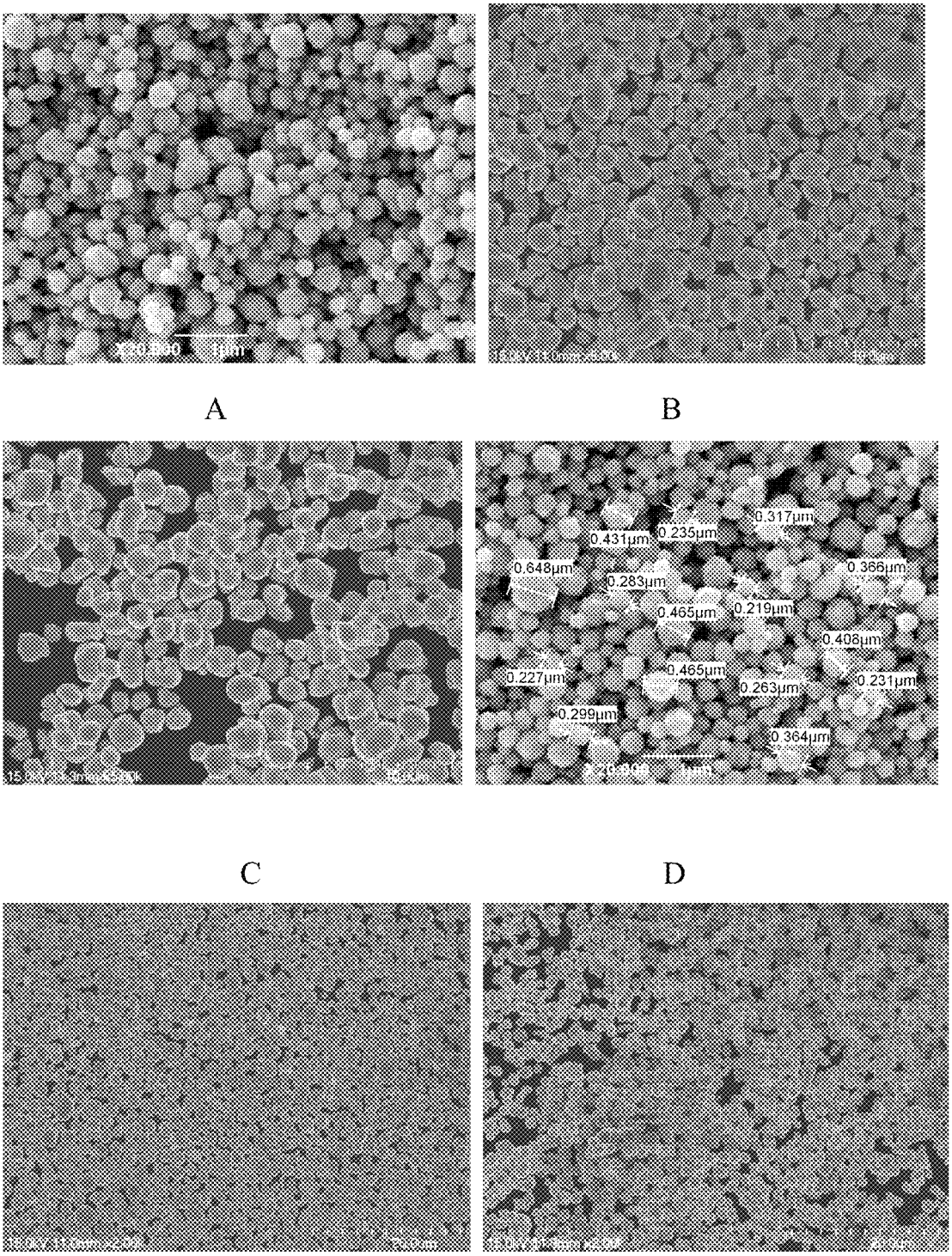

250 kg of silver nitrate solid is added to a preparation tank of 1000 L, 800 L of deionized water is added and stirred well, and 250 L of ammonia water of 23% is added to the solution to obtain a silver-ammonia solution, which is heated to 35° C. and kept constant for future use (oxidant solution);

500 L of deionized water is added to another preparation tank of 1000 L, then 150 kg of vitamin C and 55 kg of hydroxylamine sulfate are added and fully dissolved, and the solution is heated to 35° C. and kept constant for future use (reductant solution);

The electron micrographs of the silver powder S001 are shown in FIGS. 3A and 3D, the electron micrographs of the silver powder S002 are shown in FIGS. 3B and 3E, and the electron micrographs of the silver powder S003 are shown in FIGS. 3C and 3F.

The technical content and the technical features of the present invention have been disclosed as above, but those skilled in the art can still make various substitutions and modifications without departing from the spirit of the present invention based on the teachings and disclosures of the present invention. Therefore, the scope of protection of the present invention should not be limited to the disclosure of the examples, but should include various substitutions and modifications without departing from the present invention, which are covered by the claims of the patent application.

What is claimed is:

1. A method for preparing silver powder, comprising the following steps:

(1) preparing an oxidant solution, the oxidant solution including silver nitrate or silver sulfate, having a silver concentration of 0.1-10 mol/L, and being kept at 10° C. to 50° C.;

(2) preparing a reductant solution, the reductant solution including a reductant selected from the group consisting of a hydroxylamine compound, vitamin C, a 37% to 40% formaldehyde solution, and hydrazine hydrate, having a reductant concentration of 0.1-10 mol/L, and being kept at 10° C. to 50° C., a volume of the reductant solution being 0.5-5 times a volume of the oxidant solution;

(3) preparing a dispersant solution, the dispersant solution including a dispersant selected from the group consisting of polyvinylpyrrolidone (PVP), poly(ethylene glycol) 400 (PEG), polyoxyethylenesorbitan monopalmitate, and glycerol and being kept at 10° C. to 50° C., a weight of the dispersant in the dispersant solution being 0.01-5 times a weight of the silver in the oxidant solution;

(4) preparing a flocculant solution, the flocculant solution including alcohol and a flocculant selected from the group consisting of oleic acid and an oleate, a weight of the flocculant is 0.01% to 10% of the silver in the oxidant solution;

(5) adding the dispersant solution in a reaction vessel, generating controllable micro-nano bubbles in the dispersant solution by using a micro-nano bubble generator, the micro-nano bubbles being introduced as crystal seeds, adding the oxidant solution and the reductant solution simultaneously to the dispersant solution at a flow rate of 0.1-100 L/min; and (6) discharging a mixture of the dispersant solution, the oxidant solution and the reductant solution from step (5) into a flocculation sedimentation tank, adding the flocculant solution, stirring for 1-60 min, and standing for precipitation to obtain nearly spherical silver powder having an average particle size of 0.1-10 μm, wherein in step (5), the oxidant solution and the reductant solution are simultaneously sprayed through micropores into the dispersant solution at a flow rate of 50 L/min and stirred at 120 rpm.

2. The method of claim 1, wherein the reductant is the hydroxylamine compound is selected from the group consisting of hydroxylamine, hydroxylamine sulfate, and hydroxylamine nitrate.

3. The method of claim 1, wherein the silver powder particles have an internal loose structure that aids an activity of the silver powder particles.

* * * * *